US005119945A

United States Patent [19]

Wiggins

[11] Patent Number: 5,119,945

[45] Date of Patent: Jun. 9, 1992

[54] GONDOLA DISPLAY WITH IMPROVED DISPLAY RACK AND RACK LOCK

[75] Inventor: William B. Wiggins, Marietta, Ga.

[73] Assignee: L&P Property Management Company, Chicago, Ill.

[21] Appl. No.: 602,677

[22] Filed: Oct. 24, 1990

[51] Int. Cl.[5] ..... A47F 7/00

[52] U.S. Cl. ..... 211/59.2; 211/90; 211/184

[58] Field of Search ..... 211/74, 90, 184, 59.2; 24/671, 672, 707.5; 403/240, 373

[56] References Cited

U.S. PATENT DOCUMENTS

| | | | |
|---|---|---|---|
| Re. 30,706 | 8/1981 | Bustos . | |
| 1,153,615 | 9/1915 | Forsheim | 24/707.5 X |
| 2,868,391 | 1/1959 | Sides | 211/184 X |
| 2,933,195 | 4/1960 | Radek | 211/184 X |
| 3,501,020 | 3/1970 | Krikorian | 211/184 |
| 3,750,894 | 8/1973 | Jensen et al. | 211/184 |
| 3,827,574 | 8/1974 | Craig, Sr. | 211/184 |
| 4,210,986 | 7/1980 | Williams | 24/671 X |
| 4,293,062 | 10/1981 | Bustos . | |
| 4,294,363 | 10/1981 | Oztekin et al. | 211/59.2 |
| 4,346,806 | 8/1982 | Bustos | 211/59.2 X |
| 4,461,388 | 7/1984 | Bustos | 211/59.2 |
| 4,519,508 | 5/1985 | Gullett et al. . | |
| 4,744,475 | 5/1988 | St. Pierre | 403/240 X |
| 4,809,855 | 3/1989 | Bustos . | |
| 4,872,567 | 10/1989 | Bustos . | |

FOREIGN PATENT DOCUMENTS

| | | | |
|---|---|---|---|
| 0262773 | 10/1965 | Australia | 211/184 |
| 0013994 | 12/1909 | United Kingdom | 24/707.5 |

*Primary Examiner*—David M. Purol
*Assistant Examiner*—Sarah A. Lechok
*Attorney, Agent, or Firm*—Wood, Herron & Evans

[57] ABSTRACT

A gondola display with improved display rack and rack lock is disclosed which utilizes previously unused shelf space by locating a row of product which spans the ends of two abutted display shelves within a novel wire display rack, and which has a rack lock incorporated within the display shelves for securing wire legs of the wire display rack within the edge of the display shelf by biasing and forcing the rack legs against edges of holes in the shelf edge with spring clips.

12 Claims, 3 Drawing Sheets

GONDOLA DISPLAY WITH IMPROVED DISPLAY RACK AND RACK LOCK

BACKGROUND OF THE INVENTION

1. Field of Invention

This invention relates to display racks and particularly to gondola display racks of the type having shelves cantilevered over a base from vertical supporting posts. More specifically, this invention is directed to an improved shelf for use in a gondola display.

2. Description of Prior Art

Typically, a gondola display has a base, vertical gondola posts extending upwardly from the rear of the base, and one or more gondola shelves cantilevered from the vertical posts over the base. When used to support and display, for example, beverage bottles, the gondola display shelf typically has column defining divider wires mounted atop the shelf and extending from the front to the rear of the shelf for maintaining the bottles in columns or rows. Such a gondola display is disclosed for example in U.S. Pat. Nos. 4,872,567 and 4,809,855, assigned to the assignee of this invention.

Manufacturers have traditionally employed divider racks mounted atop gondola shelves for neatly organizing and separating different items or products for sale. These divider racks are typically constructed so as to allow rows of items to be displayed along the depth of the gondola shelf. The number of rows of items displayed on any particular shelf depends on the shelf width and the width of the displayed product. The rows or channels defined by the divider rack have heretofore often been of a width dimension creating a rather loose fit of displayed product within the divider rack channels because the standard width shelf often resulted in a fraction of a width channel being wasted. While a loose fit is desirable in order to allow articles to freely slide over an inclined shelf surface toward the front of the gondola display shelf, usable shelf space is forgone to the extent that the gondola shelf channel widths exceed a whole multiple of the product or article width.

According to one aspect of this invention, excess space between displayed product and channel sides is minimized while still allowing the product to freely slide forward to the front of the display. To this end and according to the practice of this invention, one one-half width channel is located at one end of the shelf but that one one-half width channel is utilized when two identical gondola shelves are abutted such that the two one-half-width channels together create an additional usable full-width channel. Thereby more efficient use is made of the available shelf space.

Another aspect of this invention is predicated upon an improved mechanism for attaching and locking a gondola shelf divider rack atop the shelf, which mechanism absolutely locks the divider rack to the shelf such that it may not be inadvertently dislodged from the shelf, even when severely impacted by product sliding on the shelf.

SUMMARY OF THE INVENTION

The gondola display of this invention comprises a base, vertical gondola posts, a gondola shelf, a wire divider rack, and a lock mechanism for securing the wire divider rack atop the gondola shelf. The vertical gondola posts contain slots along their length and accept hooks which extend rearwardly from the gondola shelves enabling the shelves to be hung in cantilever style from the gondola posts. The wire divider rack of this invention has wires legs which extend downwardly and when inserted into the lock mechanism of the gondola shelf securely anchor the rack to the shelf.

The gondola divider rack of this invention has front and rear grids which are generally rectangular, with front and rear extending divider wires connecting the grids at their upper edges. This configuration of rack defines a plurality of channels along the depth of the gondola shelf, within which may be displayed articles for sale.

The divider wires are spaced along the grids such that multiple channels are formed, plus an additional fractional width channel. The width of the fractional width channel is equal to one-half the width of the full-width channels. Therefore, when two of these divider racks are placed atop two gondola shelves and the one-half width channels are abutted end-to-end, an additional full width channel is formed from previously unused shelf space.

The gondola shelf of this invention includes a mechanism contained within the gondola shelf edge for permanently securing the divider rack to the display shelf. The lock mechanism anchors the wire legs of the divider rack within the edge of the shelf by allowing the legs to first pass through holes in the shelf surface and next through holes in an intermediate, or retainer surface. The wire legs are advanced until they contact a third, or bottom surface. A downwardly angled retainer spring clip engages the legs of the wire rack and biases and locks the rack legs against the edges of the holes in the shelf surface and the intermediate surface.

The lock mechanism is constructed of a simple sheet metal channel which runs the length of the gondola shelf at its edge. The edge of the gondola shelf is stamped or otherwise formed such that, when the sheet metal channel is attached thereto, the shelf edge serves as the intermediate or retainer surface between the two parallel sides of the sheet metal channel. Holes in the top side of the sheet metal channel and in the shelf allow the legs of the wire rack to pass through until contacting the bottom side of the sheet metal channel. Spring clips are attached to the underneath side of the shelf at points along the shelf's width which correspond to the wire rack leg hole placement. These springs are formed so as to angle downwardly into the imaginary cylinders defined by the holes in the top side of the sheet metal channel and the shelf so that the legs of the wire rack engage these springs and are thereby locked against upward movement as the legs pass through the shelf and toward the bottom side of the sheet metal channel.

Rather than using individual spring clips for each wire rack leg, a continuous piece of sheet metal is preferably utilized which, when slotted along its length, forms a plurality of individual spring clips.

DESCRIPTION OF PREFERRED EMBODIMENTS

Figure 1:
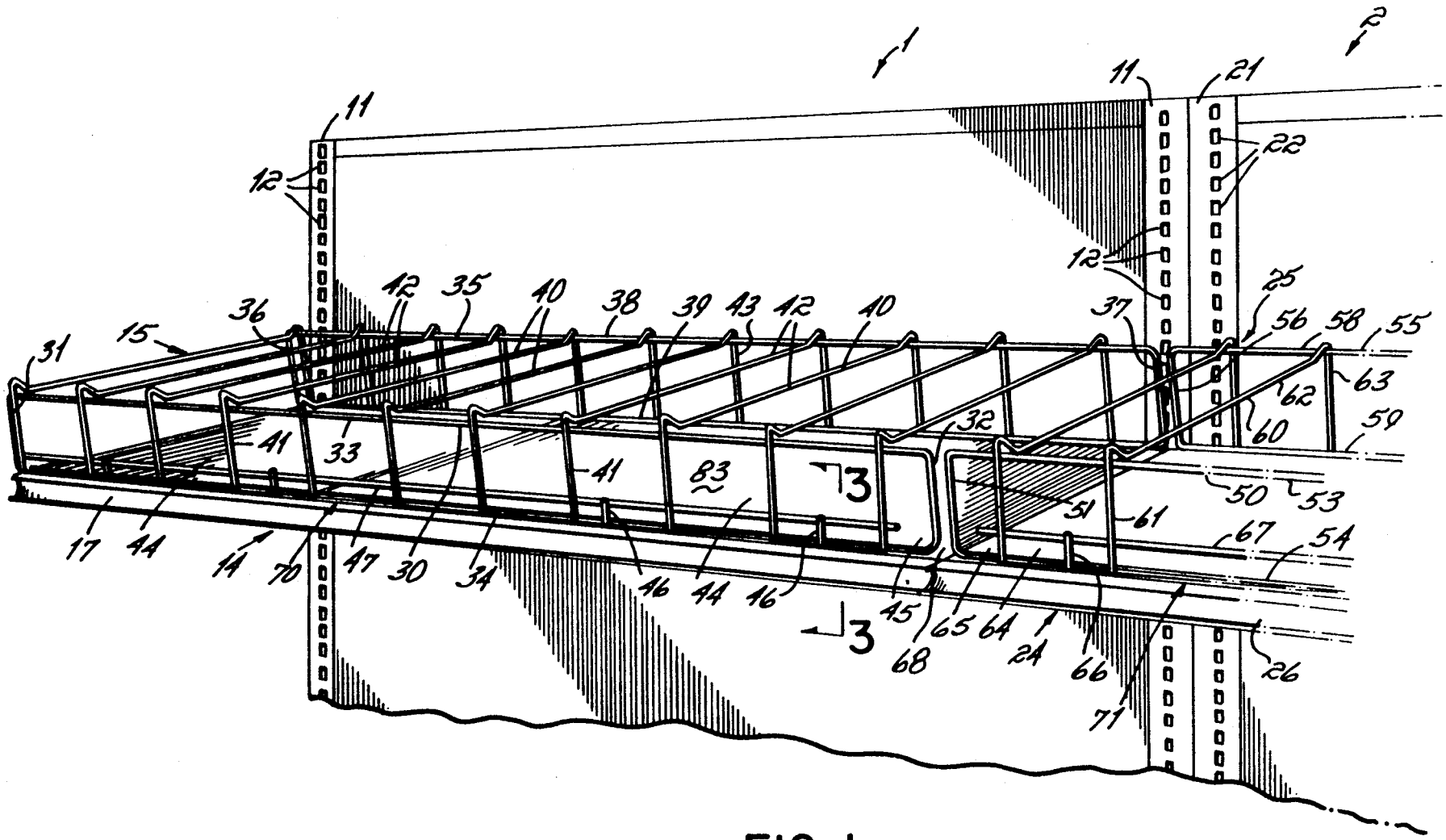
FIG. 1 is a perspective view of a portion of one gondola display and a portion of another embodying the invention of this application.
Figure 2:
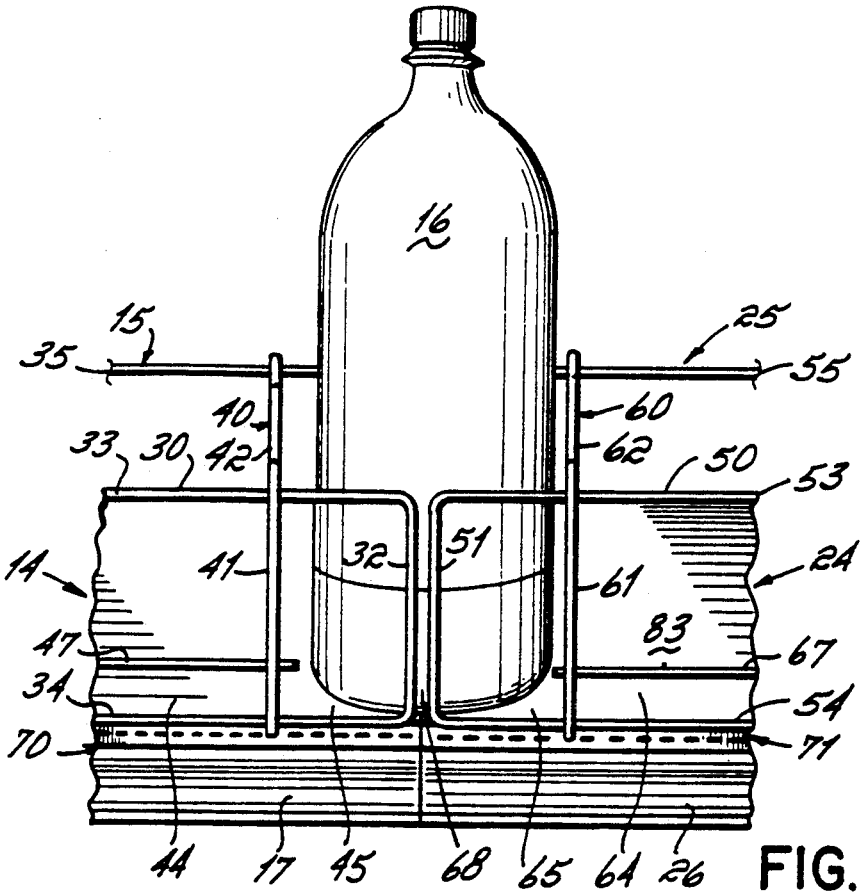
FIG. 2 is a front elevational view of a full-width gondola shelf channel generated when two one-half-width gondola shelf channels are abutted.
Figure 6:
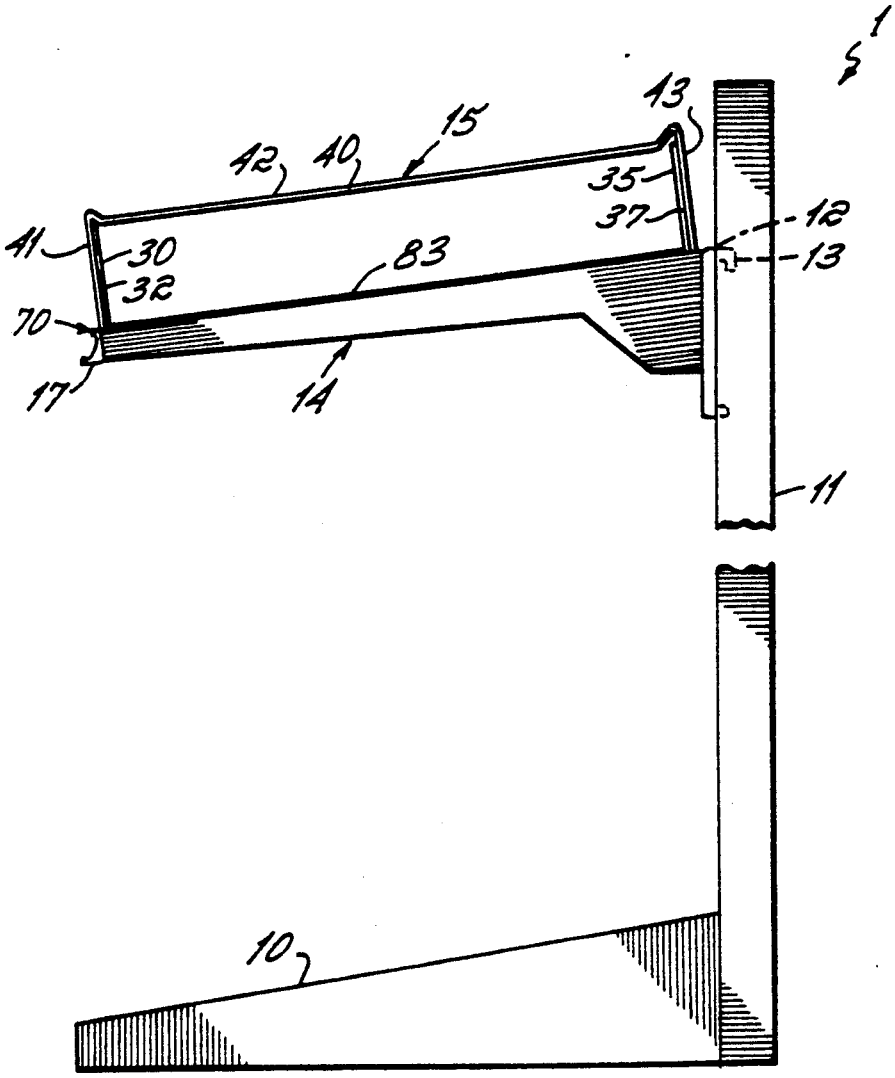
FIG. 6 is a side elevational view of a gondola display embodying the invention of this application.

Referring first to FIG. 1, gondola displays 1 and 2 are illustrated as being adjacent one another. Gondola display 1 comprises a base 10 (FIG. 6), from which extend upwardly and vertically gondola posts 11. The gondola posts 11 have vertically spaced slots 12 into which are inserted hooks 13 (FIG. 6) of a gondola shelf 14 to removably secure the shelf 14 to the posts 11. Mounted atop the gondola shelf 14 is a wire shelf divider rack 15, which functions to define rows or channels for receiving rows of product 16 (FIG. 2). Attached to the front edge of the shelf 14 is a label holder 17.

Gondola display 2 is of like construction and materials of gondola display and therefore gondola display 2 will not be described in detail. Similarly, gondola display 2 comprises a base (not shown), gondola posts 21 (only one of which is shown) with slots 22, a gondola shelf 24 mounted to posts 21 via hooks (not shown), and wire shelf divider rack 25 atop shelf 24. Attached to the front edge of shelf 24 is a label holder 26.

Describing the wire shelf divider rack 15 of gondola display 1 in more detail, a front grid 30 is rectangularly formed out of a length of steel wire with the ends of the wire butt-welded together to form a one-piece construction. Front grid 30 has ends 31 and 32, an upper side 33 and a lower side 34. A rear grid 35 is identically constructed and has ends 36 and 37, an upper side 38 and a lower side 39. Connecting the front grid 30 with the rear grid 35 and defining channels along the length of the wire shelf divider rack 15 of gondola display are divider wires 40. The divider wires 40 are likewise constructed of steel wire and are welded at their connection points with the front grid 30 and the rear grid 35. The divider wires 40 originate at the lower side 34 of the front grid 30 and extend upwardly forming a front vertical portion 41; these divider wires 40 are partially crimped around the upper side 33 of the front grid 30, then extend rearwardly to the upper side 38 of the rear grid 35 forming a divider portion 42. These divider wires 40 are again partially crimped around that upper side 38 of rear grid 35, and then extend downwardly and terminate at lower side 39 of the rear grid 35 forming a rear vertical portion 43. The divider wires 40 are spaced along the front and rear grids 30 and 35 to form a plurality of full width channels 44 and one one-half width channel 45 which is located at the end of the wire shelf divider rack 15. In order to secure the wire shelf divider rack 15 to the shelf 14, the rack 15 is outfitted with wire rack legs 46. To facilitate attaching the wire rack legs 46 to the rack 15, a horizontal wire 47 is welded to the front vertical portions 41 of the divider wires 40. This horizontal wire 47 is welded to the insides of the front vertical portions 41 of the divider wires 40 and near their bottoms, or points of origination. This horizontal wire 47 along with the lower side 34 of the front grid 30 serve as the points of attachment for the wire rack legs 46. These wire rack legs 46 are welded to the outer side of the horizontal wire 47, extend downwardly, and are welded to the lower side 34 of the front grid 30 on its outer side; thus the wire rack legs 46 and the front vertical portions 41 of the divider wires 40 are generally in the same plane and likewise the horizontal wire 47 and the lower side 34 of the front grid 30 are generally in the same plane. The rack legs 46 then extend downwardly from the lower side 34 of the front grid 30 to enable engagement with the shelf 14.

As previously mentioned, wire shelf divider rack 25 is of substantially similar construction to that of wire shelf divider rack 15. Rack 25 is positioned atop shelf 24 such that it is reversed end-to-end when compared to rack 15 atop shelf 14. In other words, rack 25 is positioned such that it is a mirror image of rack 15 about a plane defined by their joinder when they are abutted. Wire rack 25 has a front rectangular grid 50, with an end 51 (other end not shown), an upper side 53 and a lower side 54. Wire rack 25 also has a rear rectangular grid 55, with an end 56 (other end not shown), an upper side 58 and a lower side 59. Wire rack 25 has divider wires 60 spaced along its length, each of which has a front vertical portion 61, a divider portion 62, and a rear vertical portion 63. These divider wires form a plurality of full-width channels 64 along the length of the rack 25, with one one-half width channel 65 being located at the end of the rack 25. The wire rack 25 has rack legs 66 for attaching the rack 25 to the shelf 24. These wire rack legs 66 are connecfed to a horizontal wire 67 and to the lower side 54 of the front grid 50.

As mentioned previously, the rack 25 atop the shelf 24 is reversed end-to-end when compared to the rack 15 atop the shelf 14. Therefore, when gondola displays as hereinabove described are positioned adjacent one another, the one-half width channel 45 of the rack 15 is abutted with the one-half width channel 65 of the rack 25. Such a positioning thereby creates an additional usable full width channel 68.

Referring now to FIG. 2, a product for sale such as a bottle of beverage 16 is shown contained within the full width channel 68 generated by abutting the one-half-width channel 45 of rack 15 with the one-half-width channel 65 of rack 25.

Figure 3:
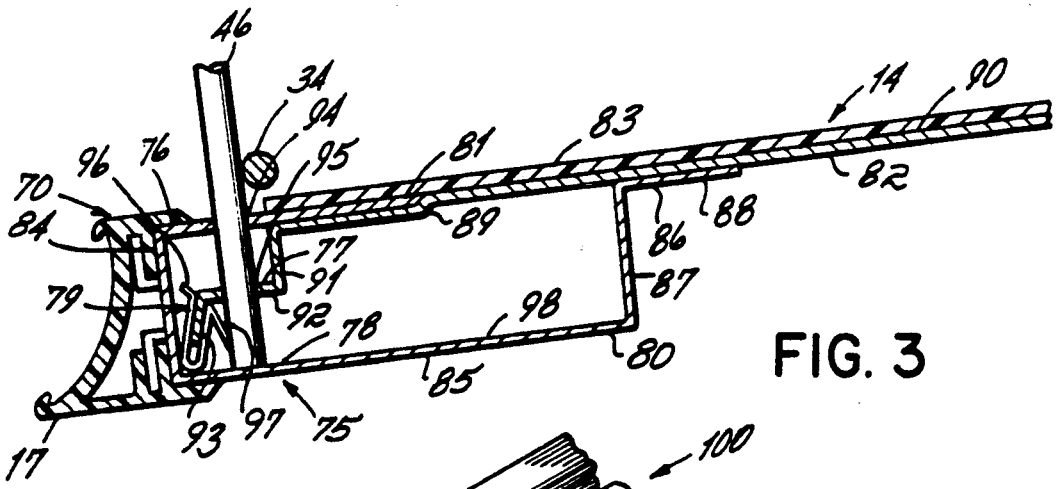
FIG. 3 is a cross-sectional view taken on lines 3—3 of FIG. 1 and illustrating the wire rack leg locking mechanism contained within the front edge of the gondola shelf.

In order to securely lock the racks 15 and 25 via rack legs 46 and 66 into the front edges 70 and 71 of the shelves 14 and 24, a wire rack leg locking device 75 illustrated in FIGS. 1 and 3 is utilized. The wire rack leg locking device 75 has four functional components: a top surface 76, an intermediate surface 77, a bottom surface 78, and a retainer spring clip 79.

Referring now to FIG. 3, and describing the wire rack leg locking device 75 in more detail, the top surface 76 corresponds to an upper side 81 of a sheet metal channel 80 oriented generally sideways. This upper side 81 of the sheet metal channel 80 lies upon a sheet metal shelf plate 82 and beneath a low coefficient-of-friction shelf covering material 83. The vertically oriented side 84 of the sheet metal channel 80 corresponds generally to the front edge 70 (or 71) of the shelf 14 (or 24). The lower side 85 of the sheet metal channel 80 is longer than the upper side 81, and has a flange 86 which includes a vertical portion 87 and a horizontal portion 88. This horizontal portion 88 of the flange 86 is used to secure the sheet metal channel 80 to the underneath side of sheet metal shelf plate 82. Attached to the front edge 70 of shelf 14 is a label holder 17.

Describing the sheet metal shelf plate 82 in more detail, a lip 89 is stamped or otherwise formed into this shelf plate 82 to enable the upper side 81 of the sheet metal channel 80 to lie coplanar with a shelf surface 90 of the sheet metal shelf plate 82. This enables the low coefficient-of-friction shelf covering material 83 to smoothly overlie both the upper side 81 of the sheet metal channel 80 and the shelf surface 90 of the sheet metal shelf plate 82. The sheet metal shelf plate 82 has a downwardly-extending first step surface 91 which is generally perpendicular to the shelf surface 90 and extends from a frontmost edge of same. A second step surface 92 extends frontwardly from the lower edge of first step surface 91, and is generally parallel to the shelf surface 90. A third step surface 93 extends downwardly from the frontmost edge of the second step surface 92 and is generally perpendicular to the shelf surface 90. The upper side 81 of the sheet metal channel 80 and the second step surface 92 of the sheet metal shelf plate 82 contain holes 94 and 95 into which are inserted wire rack legs 46 (or 66) of divider rack 15 (or 25). In order to secure these rack legs 46 (or 66), a retainer spring clip 79 is secured to the front edge of the shelf plate 82. This clip 79 is generally U-shaped such that it can be slipped over the third step surface 93 of the shelf plate 82. This clip 79 has a short, upwardly bent tang 96 which aids in guiding the clip 79 onto the third step surface 93. Opposite this short tang 96 is a downwardly bent spring portion 97. As the rack leg 46 (or 66) passes through the second step surface 92, it contacts the spring portion 97 of the retainer spring clip 79. As the rack leg 46 (or 66) is advanced further, the spring portion 97 is deflected thereby biasing and forcing the rack leg 46 (or 66) against the edges of holes 94 and 95 in the upper side 81 of t he sheet metal channel 80 and the second step surface 92 of the sheet metal shelf plate 82. The rack leg 46 (or 66) is advanced further until contacting the top surface 98 of the lower side 85 of the sheet metal channel 80.

Figure 4:
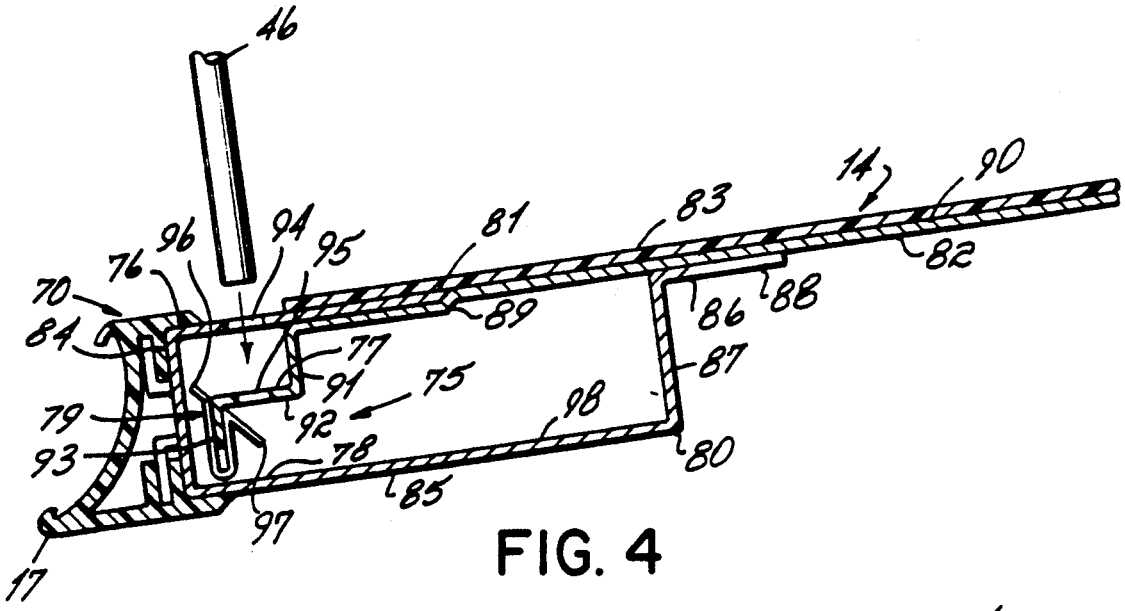
FIG. 4 is a view similar to FIG. 3 but with the wire anchor leg of the shelf rack withdrawn from its shelf support.

Referring now to FIG. 4, the wire rack leg locking device 75 is illustrated with the rack leg 46 (or 66) withdrawn. As can be seen, the spring portion 97 of the retainer spring clip 79 in its undeflected state extends into an imaginary cylinder formed by the holes 94 and 95 in the upper side 81 of sheet metal channel 80 and the second step surface 92 of the sheet metal shelf plate 82 respectively. While the retainer spring clip 79 is shown attached to the third step surface 93, intermediate of the intermediate surface 77 and bottom surface 78, an equivalently functioning arrangement would be to position the spring clip 79 intermediate of the top surface 76 and the intermediate surface 77.

Figure 5:
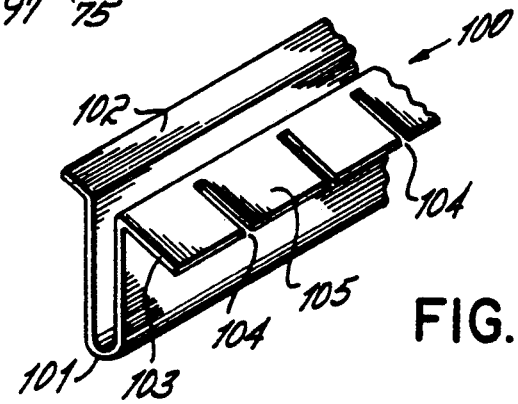
FIG. 5 is a perspective view of a one-piece sheet metal spring clip used to secure a multiplicity of wire rack legs to a shelf.

Referring now to FIG. 5, an alternative spring clip 100 is illustrated which is fabricated from a continuous piece of sheet metal. This continuous piece of sheet metal is bent in a U-shape 101, has an upwardly bent tang 102 to aid in installation over the third step 93 of the sheet metal shelf plate 82, and has a downwardly bent spring portion 103. This downwardly bent spring portion 103 is slotted along its length with slots 104, thereby forming a continuous plurality of spring clips 105.

In assembling the gondola display shelf 14 of the present invention, the retainer spring clips 79 are press fitted or otherwise attached to the third step surface 93 of the sheet metal shelf plate 82 at points along the length of the shelf plate 82 corresponding to the placement of the holes 95 in the second step surface 92 of the shelf plate 82. The wire shelf divider rack 15 is then mounted atop the gondola dislay shelf 14 with the rack 15 oriented such that the one-half-width channel 45 is located on the end of gondola shelf 14 for which is desired an additional full-width channel 68 to be located. The wire rack legs 46 of the display rack 15 are inserted first through the holes 94 in the upper side 81 of the sheet metal channel 80. These rack legs 46 are then further advanced until passing through the holes 95 in the second step surface 92 of the sheet metal plate 82. The rack legs 46 are further advanced until contacting the spring portion 97 of the retainer spring clip 79. The rack legs 46 are finally advanced against that spring portion 97 until the bottom of the rack legs 46 contact the upper surface of the lower side 85 of the sheet metal channel 80. The spring portion 97 of the retainer clips 79 assumes its fully deflected state, thereby biasing and forcing the rack legs 46 against the edges of the holes 95 and 94 in the second step surface 92 of sheet metal plate 82 and the upper side 81 of the sheet metal channel 80.

The display shelf 14 with the display rack 15 mounted thereon is then ready for assembly onto the vertical gondola posts 11. The hooks 13 extending from the rear edges of the shelf 14 are inserted into the vertically spaced slots 12 of the vertical gondola posts 11 at the desired height.

A complementing gondola display is likewise assembled but with the wire rack 25 atop the shelf 24 reversed end-to-end when compared to the rack 15 atop the shelf 14. With this rack 25 atop this shelf 24 and mounted to vertical posts 21 via the slots 22, the second gondola display may be abutted against the first gondola display hereinabove described. This arrangement thereby permits the additional full-width channel 68 to be formed by the half-width channel 45 of rack 15 and the half-width channel 65 of the rack 25 atop shelves 14 and 24, respectively.

The invention claimed is:

1. A gondola display comprising a base having front and rear sides, gondola posts extending vertically from the rear of said base, said posts containing vertically spaced slots on the front side thereof, a gondola shelf, said shelf defining a front side, a rear side, and a shelf surface extending between said front and rear sides, said shelf having hooks extending rewardly from its rear side, said hooks being receivable into said slots of said gondola posts, said shelf surface containing holes generally perpendicular to said shelf surface along front and rear edges of said shelf, a wire shelf divider rack, said rack having front and rear wire grids and divider wires extending between said grids and defining channels above said shelf surface, said grids having vertical wire legs extending downwardly from said grids and received in said holes in said shelf surface, and a lock mechanism engagable with said vertical legs to lock said wire shelf divider rack to said gondola shelf.

2. The gondola display of claim 1, wherein said wire shelf divider rack front and rear grids are generally rectangular, said divider wires connecting said grids together at their upper edges and defining a plurality of channels, said channels traversing a distance between said front and rear grids, wherein said shelf having said rack mounted thereon may be utilized for displaying articles in rows, said rows of said articles contained within said channels, said divider wires spaced accordingly.

3. The gondola display of claim 2, wherein said divider wires connecting said grids together define a plurality of full-width channels and one one-half-width channel, said one-half-width channel being half the width of one of said full-width channels, said one-half-width channel being located at the end of said rack, whereby when two racks are attached to said two gondola shelves and said two shelves are abutted end to end thereby placing said one-half-width channels together, an additional channel is defined which spans the ends of said two shelves.

4. The gondola display of claim 1 wherein the lock mechanism comprises a top surface, a retainer surface parallel to and underneath said top surface, said retainer surface being spaced away from said top surface, a bottom surface parallel to and underneath said retainer surface, said bottom surface being spaced away from said retainer surface, and a retainer spring clip between said retainer surface and said bottom surface;

said top surface and said retainer surface having holes with a common axis generally perpendicular to said top and retainer surfaces, said holes being of a diameter slightly larger than the diameter of said wire legs of said rack so as to be able to accept said wire rack legs without undue binding, said retainer spring clip extending in a downward direction below said retainer surface and into an imaginary cylinder formed by said top surface hole and said retainer surface hole said wire rack legs introduced through first said top surface hole and then said retainer surface hole, said wire rack legs engaging said spring clip, said wire rack legs contacting said bottom surface, said spring clip biasing said wire rack legs against an edge of said top surface hole and said retainer surface hole.

5. The gondola display of claim 4, wherein said top surface corresponds to a top surface of a sheet metal channel, said bottom surface corresponds to a bottom surface of said sheet metal channel, said retainer surface being a part of a sheet metal shelf plate, said shelf plate having a shelf surface, a first step surface perpendicular to said shelf surface, a second step surface parallel to said shelf surface, and a third step surface perpendicular to said shelf surface, said retainer surface corresponding to said second step surface, and said retainer spring clip attached to said third step surface, said spring portion extending downwards approximately 45° from said second step surface and extending into said imaginary cylinder formed by said sheet metal channel top surface hole and said sheet metal shelf second step surface hole.

6. The gondola display of claim 5 wherein said retainer spring clip is a continuous length of sheet metal, said sheet metal having slots spaced along the length thereof defining a plurality of retainer spring clips.

7. A wire shelf divider rack for use atop a gondola display shelf, said rack having rectangular front and rear grids and divider wires extending between said grids and defining channels above said shelf, said grids having vertical wire legs extending downwardly therefrom and receivable in holes in said shelf, said divider wires connecting said grids together at their upper edges and defining a plurality of full-width channels and one one-half-width channel, said one-half-width channel being half the width of one of said full-width channels, said one-half-width channel being located at the end of said rack, said channels traversing a distance between said front and rear grids, whereby when said two racks are attached to two shelves and said two shelves are abutted end to end thereby placing said one-half-width channels together, an additional channel is defined which spans the ends of said two shelves, wherein said shelf having said rack mounted thereon may be utilized for displaying articles in rows, said rows of said articles contained within said channels, said divider wires spaced accordingly.

8. A lock mechanism for attaching a wire shelf divider rack having vertical wire legs extending downwardly therefrom to a gondola display shelf, said lock mechanism engagable with said vertical legs to lock said shelf and comprising a top surface, a retainer surface parallel to and underneath said top surface, said retainer surface being spaced away from said top surface, a bottom surface parallel to and underneath said retainer surface, said bottom surface being spaced away from said retainer surface, and a retainer spring clip between said retainer surface and said bottom surface;

said top surface and said retainer surface having holes with a common axis generally perpendicular to said top and retainer surfaces, said holes being of a diameter slightly larger than the diameter of said wire legs of said rack so as to be able to accept said wire rack legs without undue binding, said retainer spring clip extending in a downward direction below said retainer surface and into an imaginary cylinder formed by said top surface hole and said retainer surface hole, said wire rack legs introduced through first said top surface hole and then said retainer surface hole, said wire rack legs engaging said spring clip, said wire rack legs contacting said bottom surface, said spring clip biasing said wire rack legs against an edge of said top surface hole and said retainer surface hole.

9. The lock mechanism of claim 8, wherein said top surface corresponds to a top surface of a sheet metal channel, said bottom surface corresponds to a bottom surface of said sheet metal channel, said retainer surface being a part of a sheet metal gondola shelf plate, said shelf plate having a shelf surface, a first step surface perpendicular to said shelf surface, a second step surface parallel to said shelf surface, and a third step surface perpendicular to said shelf surface, said retainer surface corresponding to said second step surface, and said retainer spring clip attached to said third step surface, said spring portion extending downwards approximately 45° from said second step surface and extending into said imaginary cylinder formed by said sheet metal channel top surface hole and said sheet metal shelf second step surface hole.

10. The lock mechanism of claim 9 wherein said retainer spring clip is a continuous length of sheet metal, said sheet metal having slots spaced along the length thereof defining a plurality of retainer spring clips.

11. The gondola display of claim 1 wherein the lock mechanism comprises:

a top surface;

a retainer surface parallel to and underneath said top surface, said retainer surface being spaced away from said top surface, said top and retainer surfaces defining therebetween a first space;

a bottom surface parallel to and underneath said retainer surface, said bottom surface being spaced away from said retainer surface, said bottom and retainer surfaces defining therebetween a second space; and a retainer spring clip disposed in one of said first and second spaces;

said top surface and said retainer surface having holes with a common axis generally perpendicular to said top and retainer surfaces, said holes being of a diameter slightly larger than the diameter of said wire legs of said rack so as to be able to accept said wire rack legs without undue binding, said retainer spring clip extending into an imaginary cylinder formed by said top surface hole and said retainer surface hole such that when said wire rack legs are introduced through said top surface hole and said retainer surface hole and forced into contact with said bottom surface, said spring clip biases said wire rack legs against an edge of said top surface hole and said retainer surface hole.

12. The gondola display of claim 11 wherein said spring clip is disposed in said first space.

* * * * *